US008984907B2

(12) United States Patent
Schill

(10) Patent No.: US 8,984,907 B2
(45) Date of Patent: Mar. 24, 2015

(54) APPARATUS FOR PRODUCING FLAKE ICE

(75) Inventor: Joachim Schill, Kehl (DE)

(73) Assignee: Maja-Maschinenfabrik Hermann Schill GmbH & Co. KG, Kehl-Goldscheuer (DE)

( * ) Notice: Subject to any disclaimer, the term of this patent is extended or adjusted under 35 U.S.C. 154(b) by 377 days.

(21) Appl. No.: 13/256,395

(22) PCT Filed: Mar. 15, 2010

(86) PCT No.: PCT/DE2010/000280
§ 371 (c)(1),
(2), (4) Date: Sep. 13, 2011

(87) PCT Pub. No.: WO2010/105600
PCT Pub. Date: Sep. 23, 2010

(65) Prior Publication Data

US 2012/0000235 A1 Jan. 5, 2012

(30) Foreign Application Priority Data

| | | |
|---|---|---|
| Mar. 14, 2009 | (DE) | 10 2009 012 867 |
| Apr. 9, 2009 | (DE) | 10 2009 016 726 |
| Jul. 31, 2009 | (DE) | 10 2009 035 854 |

(51) Int. Cl.
*A23G 9/00* (2006.01)
*F25C 1/14* (2006.01)

(52) U.S. Cl.
CPC ..... *F25C 1/142* (2013.01); *F25C 2400/12* (2013.01)
USPC ..... 62/346; 62/345; 62/347; 62/354

(58) Field of Classification Search
CPC ..... F25C 1/10; F25C 1/12; F25C 1/14; F25C 2305/002; F25C 2400/14
USPC ..... 62/346, 347, 354, 320, 353, 345
See application file for complete search history.

(56) References Cited

U.S. PATENT DOCUMENTS

| | | | | | |
|---|---|---|---|---|---|
| 1,823,806 | A | | 9/1931 | Spreen | |
| 2,344,922 | A | | 3/1944 | Raver | |
| 2,549,215 | A | * | 4/1951 | Mansted | 62/346 |
| 2,749,722 | A | * | 6/1956 | Knowles | 62/346 |
| 5,257,510 | A | * | 11/1993 | Cox | 62/346 |
| 5,820,447 | A | * | 10/1998 | Niechcial | 451/99 |

(Continued)

FOREIGN PATENT DOCUMENTS

| | | |
|---|---|---|
| DE | 89 12 336 U1 | 2/1990 |
| DE | 41 08 911 A1 | 9/1992 |

(Continued)

*Primary Examiner* — Mohammad M Ali
*Assistant Examiner* — Raheena Rehman
(74) *Attorney, Agent, or Firm* — Shlesinger, Arkwright & Garvey LLP

(57) ABSTRACT

An apparatus for producing flake ice from a liquid is proposed, which apparatus is equipped with a rotatably disposed evaporator roller, a shaft on the evaporator roller that transmits torque from a drive to the evaporator roller, at least two bearing bushings which are permanently disposed on the apparatus and in which the shaft is rotatably received and mounted, a scraper for stripping ice that has been formed from the liquid at the surface of the evaporator roller, a pan that is open at the top and receives the liquid to be frozen, wherein the pan is able to be inserted or slid in one piece onto the bearing bushings or onto additional coupling elements disposed on the shaft or onto the bearing bushings or directly onto the shaft, and is detachable therefrom.

18 Claims, 14 Drawing Sheets

(56) References Cited

U.S. PATENT DOCUMENTS

| | | | | |
|---|---|---|---|---|
| 5,913,711 | A * | 6/1999 | Visaisouk | 451/39 |
| 6,270,394 | B1 * | 8/2001 | Visaisouk et al. | 451/39 |
| 6,381,967 | B1 * | 5/2002 | Craig | 62/64 |
| 6,497,106 | B2 * | 12/2002 | Lang et al. | 62/63 |
| 6,577,355 | B1 * | 6/2003 | Yaniv | 349/16 |

FOREIGN PATENT DOCUMENTS

| | | | |
|---|---|---|---|
| DE | 94 03 932 | U1 | 6/1994 |
| DE | 94 12 825 | U1 | 12/1994 |
| DE | 295 17 340 | U1 | 2/1996 |
| DE | 195 32 232 | A1 | 4/1996 |
| DE | 102 21 523 | A1 | 6/2003 |
| DE | 10221523 | A1 * | 6/2003 |
| DE | 10 2005 039 989 | A1 | 3/2006 |
| DE | 601 20 188 | T2 | 3/2007 |
| DE | 10 2008 022 175 | A1 | 11/2008 |
| DE | 10 2008 062 422 | A1 | 7/2010 |
| EP | 15 91 731 | A1 | 11/2005 |
| JP | S49 112252 | A | 10/1974 |
| JP | H10 68564 | | 3/1998 |
| JP | 2002 310546 | A | 10/2002 |
| JP | 2003 130506 | U | 5/2003 |

* cited by examiner

APPARATUS FOR PRODUCING FLAKE ICE

BACKGROUND OF THE INVENTION

The invention is based on an apparatus to produce flake ice from a liquid, comprising a pan to receive the liquid, an evaporator roller that is rotatably disposed relative to the pan, and a scraper to strip the ice formed from the liquid at the surface of the evaporator roller.

Apparatuses of this type function to produce ice in the form of thin flakes from liquids, in particular water. The ice is identified as flake ice due to the shape of the ice pieces. Flake ice is utilized, for example, in the food industry to produce food and to keep food fresh during transport and storage. As a result, for example, meat, fish, or seafood can be stored and transported such that their quality does not suffer. In addition, flake ice is used in the production of sausage. Other liquids besides water can be processed into flake ice, such as, for example, juices, sauces, egg, milk, and milk products. In addition to these, flake ice produced from a variety of liquids is used in medicine, pharmacy, and engineering.

Especially stringent hygienic requirements must be met by the apparatuses in all areas of application when producing flake ice. To this end, any pathogenic organisms, in particular, viruses, molds, and protozoa must be removed from all surfaces coming in contact with the flake ice. The apparatus must be thoroughly cleaned at regular intervals, and disinfected as necessary. It is particularly important in this regard to clean the pan in which a pool of liquid is found when the apparatus is operating and during idle times between startup times. Germs can propagate unhindered in this supply of liquid. Regularly emptying the pan is not a sufficient action for reliably removing pathogens and molds from the surfaces.

DE 410 8911 A1 discloses a flake ice machine comprising a pan and an evaporator roller that is rotatably disposed on the pan, this being equipped with a switchable cleaning device for rinsing the pan and the evaporator roller. To this end, the cleaning device includes multiple spray nozzles to spray the evaporator roller and the pan with a cleaning agent. The evaporator roller and pan here are permanently attached to each other. This approach has been found to be disadvantageous in that only very limited visual monitoring of the state of the pan is possible in terms of scaling and contamination. In addition, it is impossible to remove the pan without dismantling the flake ice machine.

DE 102 21 523 A1 discloses a flake ice machine comprising an evaporator roller that is rotatably disposed on a pan, wherein the pan is composed of two side sections and a pan section that is detachably fastened to the side sections. The pan section is detached from the side sections to clean the pan. However, this approach has been found to be disadvantageous in that the side sections of the pan cannot be separated from the evaporator roller, and it is thus impossible to effect a corresponding cleaning of the side sections. In addition, the attachment for the scraper and spacer rods to set a fixed spacing between the side sections is disposed inside the pan. They therefore also have to be regularly cleaned. Cleaning them is rendered difficult, however, since they cannot be removed without dismantling the flake ice machine and are difficult to access from outside once installed.

The object of this invention is to provide an apparatus for producing flake ice that enables the pan to be detached from the apparatus without using tools so as to be able to perform a thorough cleaning of the pan.

SUMMARY OF THE INVENTION

In contrast to the prior art, the apparatus according to the invention for producing flake ice is distinguished by the fact that at least two bearing bushings are permanently disposed on the apparatus, the shaft of the evaporator being rotatably supported in these bushings. The rotatable mounting of the shaft and of the evaporator is thus completely independent of the pan. The shaft and the evaporator are then also rotatably supported on the apparatus when the pan is removed from the apparatus. Nothing changes in terms of the arrangement of the shaft and the evaporator when the pan is installed or removed. The pan is composed essentially of two pan side sections and one pan base section. The pan base section here connects the two pan side sections to each other and delimits the interior of the pan relative to the front, back, and bottom. Since the shaft and the evaporator are mounted on the apparatus independently from the pan, the pan can be completely installed and removed in one piece. Other components as well, such as, for example, the scraper to strip the layer of ice from the evaporator roller, or the liquid supply intake to introduce the liquid to be frozen into the pan are preferably not disposed on the pan, or are at least detachably connected to the pan so as to enable the complete pan to be installed and removed without dismantling the overall apparatus.

When in the installed state, the pan is attached in fluid-tight fashion to the shaft either indirectly or directly, the shaft being rotatable relative to the pan. Three variants exist for the fluid-tight attachment:

In a first variant, the pan in the installed position is attached at its pan side sections by bearing bushings that function to provide the rotatable mounting of the shaft on the apparatus. The bearing bushings here rotatably receive the shaft on its inward-facing side, while the pan side sections are disposed on the side of the bearing bushings facing outward. The section of the bearing bushings that receives the pan side sections in fluid-tight fashion can have a special shape that is matched to the pan side sections. The pan side sections can have a cutout that is matched to the section of the bearing bushings. In a second variant, the pan in the installed state is attached at its pan side sections by coupling elements that are disposed either directly on the shaft or on the bearing bushings of the shaft. As with the first variant, the coupling elements at their side facing the pan side sections can have a special shape to which the pan side sections are matched. The coupling elements can furthermore be disposed rotatably on the bearing bushings or on the shaft. This facilitates installing and removing the pan. In a third variant, the pan in the installed state is attached at its pan side sections directly to the shaft, where a seal, for example, a shaft seal, is preferably disposed between shaft and pan side sections. Since the shaft turns relative to the pan in the installed state, the seal must support the rotary motion. In contrast to the first two variants, the fluid-tight attachment is in the region of a rotatable mounting in the third variant. The two pan side sections advantageously have cutouts for the shaft. The pan can be slid or inserted onto the shaft by means of these cutouts. The pan side sections encompass the shaft at least partially in the installed state.

The pan side sections are either detachably or nondetachably joined to the pan base section. The pan is not dismantled for purposes of installation and removal. In the event it is possible to detach the pan base section from the pan side sections, separation of the parts from each other is effected in the state in which these have been removed from the apparatus. When the pan is in the position of being installed in the apparatus, the pan side sections delimit the pan in two planes running perpendicular or obliquely relative to the shaft. The pan base section can delimit the pan in planes that run parallel to the shaft. Additional shapes for the pan base section are possible that allow residual liquid to drain from the pan in the installed state as long as the pan is provided with a drain outlet for this purpose at the lowest point.

In order to attach the pan to the apparatus for producing flake ice, the pan is placed by its pan side sections on the bearing bushings, the coupling elements, or the shaft. To this end, the bearing bushings or coupling elements are of a shape that enables the pan to be inserted or slid on. The coupling elements can be disposed rotatably relative to the shaft to facilitate attaching the pan to the coupling elements. To attach the pan to the coupling elements, the coupling elements can be rotated in such a way that sufficient space is provided to the user to insert the pan while the other components of the flake ice machine do not interfere with the insertion. Once the pan has been attached to the coupling elements, the pan can be rotated or swiveled together with the coupling elements so that the pan assumes the appropriate orientation for operating the flake ice machine, in which orientation the opening of the pan faces upward.

The apparatus can additionally be equipped with retention elements or another attachment device. This ensures that the pan is pressed onto the bearing bushings, the coupling elements, or the shaft when in its operating position. This supports the fluid-tight attachment. The retention elements or the attachment device can either hold the pan from below or exert a pressure on the pan from below. A seal is preferably provided so as to make a fluid-tight connection between the pan, the bearing bushings, the coupling elements, or the shaft.

During installation, the pan can first be moved into the position intended for operating the apparatus, and optionally connected in a fluid-tight manner in this position to the bearing bushings, the coupling elements, or the shaft by means of retention elements or an attachment device. This action can be effected in one procedural step or in two separate procedural steps. In the case of one procedural step, for example, the attachment device can move into engagement with the pan as it is rotated or swiveled into the operating position by a user. In the case of two procedural steps, the attachment device is triggered in an additional procedural step after the pan has been moved into its operating position in a first procedural step. The attachment device in both cases functions as a guide for the pan as it is swiveled into the operating position.

To remove the pan from the flake ice machine, the attachment device is released as necessary, and the pan rotated or swiveled out of its operating position into a second position, where the second position enables the pan to be removed from the bearing bushings, the coupling elements, or the shaft.

Here too, releasing the attachment device, and rotating or swiveling the pan, can be effected either in a combined procedural step or in two separate procedural steps. If the pan is located in the second position, it can be dismounted from the bearing bushings, the coupling elements, or the shaft, then removed from the flake ice machine. After the pan has been detached from the apparatus, the pan is freely accessible from all sides, and can be cleaned and/or disinfected. Cleaning can be performed either manually or by machine. If the contamination is so severe that it cannot be removed by appropriate measures, or if the pan is defective, the pan can be replaced with another pan.

Once the pan has been removed from the apparatus, the evaporator roller is also freely accessible from the outside. If the apparatus for producing flake ice has a housing, this must be opened at one or multiple sides as necessary. After the pan is removed, the evaporator roller can also be completely cleaned. The apparatus can be equipped with an additional container, a drip pan, for example, to collect the cleaning fluids used for this purpose.

Installing and removing the pan is effected using only a few steps by hand. No tools are necessary for this purpose.

The scraper to strip the ice in the form of flake ice, which is produced from the liquid at the surface of the evaporator roller, is disposed outside of and independently of the pan. The scraper is permanently attached to the apparatus. A cross-member, for example, to which the scraper is attached can be provided for this purpose. When the pan is removed from the apparatus, the scraper remains in place. After the pan is removed from the apparatus, the scraper is also freely accessible and can be cleaned and/or disinfected. A housing may also have to be opened for this purpose, as necessary. The scraper and the cross-member can be easily dismounted after the pan has been removed.

The shaft can involve either a rod-shaped machine element that passes through the evaporator roller and projects beyond the evaporator roller at both end faces of the evaporator roller, or involve two shaft ends that are permanently attached to the evaporator roller and project at the end faces of the evaporator roller.

Additional components of the apparatus for producing flake ice, such as, for example, a liquid supply intake, a liquid drain, or sensors to monitor the apparatus, are either not disposed directly on the pan or are detachably connected to the pan.

This fluid-tight attachment of the pan to the bearing bushings, the coupling elements, or the shaft enables the pan to be filled with the liquid to be frozen up to a fill level above the shaft. The only requirement for this is that the upper edge of the pan side sections, and/or the upper edge of the bearing bushings or of the coupling elements, run above the shaft when the pan is in the operating position.

The coupling elements are preferably provided with a circular opening in order to rotatably dispose the coupling elements on the bearing bushings of the shaft or on the shaft, the opening being matched to the diameter of the bearing bushings or the shaft. Care must be taken in this regard that the coupling elements are sealed relative to bearing bushings or relative to the shaft. The coupling elements here can be in the form of disks with a hollow-cylindrical cutout. If the pan is slid onto the bearing bushings, these also can be of a shape that maximizes the possible fill level. Despite the pan's detachable connection to the apparatus, the fill level is thus not restricted as compared with known apparatuses having a permanently installed pan.

The pan can be composed, for example, of plastic. In this case, the pan is preferably produced in one piece. In addition, the pan can be composed of stainless steel, steel, or composite material. A pan composed of plastic has the advantage over pans made of stainless steel in that it is free of corrosion, and can be produced easily and inexpensively. In addition, a pan composed of plastic or composite material insulates the liquid bath, thereby preventing or mitigating the formation of condensation on the pan exterior, and thus yielding a savings in energy.

In an advantageous embodiment of the invention, the coupling elements encompass the shaft or the bearing bushings circumferentially.

In another advantageous embodiment of the invention, the shaft is rotatable relative to the coupling elements. Alternatively or cumulatively to this, the coupling elements are rotatable relative to the shaft. The shaft can thus rotate relative to the stationary coupling elements. Furthermore, the coupling elements can rotate relative to the stationary shaft. This last approach allows for rotation of the pan when placed on the coupling elements when the pan is installed or removed.

In another advantageous embodiment of the invention, a shaft seal is disposed on the shaft, the pan being connectable to the shaft seal. In this case, the coupling of the pan is effected directly on the shaft.

In another advantageous embodiment of the invention, the bearing bushings or the coupling elements are equipped with a seal on the side facing the pan side sections. Alternatively or cumulatively, the pan side sections are equipped with a seal on the side facing the bearing bushings or the coupling elements. The seal here can be provided only sectionally.

In another advantageous embodiment of the invention, the seal is disposed in a recess on the bearing bushings or the coupling elements on one side, and/or pan side sections on the other side. The recess can, for example, involve a groove or a notch.

In another advantageous embodiment of the invention, the pan side sections have a cutout on the side facing the opening of the pan, the outer shape and size of the cutout matching that part of the bearing bushings, the coupling elements, or the shaft equipped with a shaft seal, by which the form-fitting engagement with the pan side sections is created. When the pan is attached to the apparatus, the bearing bushings or the coupling elements together with the shaft completely fill the cutouts in the pan side sections. The result is that the pan in its operating position can be filled to a level above the shaft. The outer shape of the segment of the bearing bushings or coupling elements creating the form-fitting engagement with the pan side sections can be either angular or round. The shape is preferably such that placement of the pan on the coupling elements is possible only in one orientation, and so as to facilitate guiding the pan along coupling elements during placement of the pan. To this, for example, a profile can be provided on the side of the coupling elements facing the pan side sections, in which profile the pan side sections are guided during the placement of the pan. When the pan is in the installed state, outwardly-protruding segments of the profile can contact the pan side sections, thereby enhancing the sealing effect. Profiles of this type can be provided either cumulatively or alternatively on the pan side sections. The shape of the segments of the outward-protruding profile is arbitrary. The contours of the bearing bushings or of the coupling elements creating the form-fitting engagement with the pan side sections can be angular or round. The coupling element can thus have, for example, two sides facing the pan side sections, the edges of these sides extending in a straight line. In addition, the edges of the one side can extend at an angle that differs from 0° and 90°. The two sides can be connected to each other by a third side that also faces the pan side section. The edges of this third side can also extend in either straight or curved fashion. The two sides that are inclined relative to each other enable the pan to be centered as it is placed on the coupling elements.

In another advantageous embodiment of the invention, the apparatus is equipped with a housing on which, for example, retention elements of an attachment device are disposed, these elements holding the pan from below, and/or pressing the pan against the bearing bushings, the coupling elements, and/or the shaft. These can, for example, involve cylindrical elements, for example, jaws, that are attached to the housing and that the pan contacts when it is rotated or swiveled into its operating position. The elements here protrude from the housing far enough towards the pan that they contact the pan, in particular, the pan side sections.

In another advantageous embodiment of the invention, the pan side sections are of a round outer contour, at least in the region in which they are attached to the pan base section. The round outer contour facilitates the interaction between the attachment device and the pan when the pan is rotated or swiveled into the operating position. The pan slides at least sectionally here along the elements of the attachment device.

In another advantageous embodiment of the invention, the distance between the geometric longitudinal axis of the shaft and the outer contour of the pan side sections is shorter in a first section than in a second section. The distance here between the first and second sections increases continuously. This can apply analogously to the pan base section. When the pan is inserted in the apparatus, care must be taken that the pan is placed on the bearing bushings or the coupling elements, and if required is rotated together with the coupling elements, in such a way that the first section is located at the front and the second section at the back in the direction of motion. This enables the pan to move together with its first section past the attachment device without having the attachment device exert any force on the pan in the first section. The pan can thus be rotated further unimpeded. Due to the continuous increase in the distance during the transition from the first into the second section of the pan, the distance between the pan side sections and the attachment device is reduced continuously as the pan is rotated. The pan touches the attachment device in the second section, or shortly before reaching the second section. The result is that the attachment device contacts the pan in this second section. The attachment device can have elements that are elastically deformable. The force increases that the user must exert to move the pan with its second section along the attachment device. The user thus receives information haptically as to how far the pan has swiveled into the apparatus. Additionally, a stop can be provided on the apparatus for this purpose.

In another advantageous embodiment of the invention, the apparatus is equipped with a cross-member on which the scraper is disposed. The cross-member preferably runs parallel to the shaft of the evaporator. The scraper here is not part of the pan.

In another advantageous embodiment of the invention, the apparatus is equipped with an inclined plane along which the flake ice stripped from the evaporator roller is conducted away. The inclined plane is attached to the apparatus. The plane here covers the attachment elements by which the scraper is attached to the cross-member. This has the advantage that the attachment elements of the scraper do not come into contact with the flake ice.

In another advantageous embodiment of the invention, the apparatus is equipped with at least one liquid supply intake that introduces the liquid into the pan from the top. The liquid supply intake here is not part of the pan.

In another advantageous embodiment of the invention, the liquid supply intake has at least one outlet opening for the liquid. The opening is located below the scraper. This enables the liquid to be introduced into the apparatus at that position in which the temperature is the lowest. This creates a flow in the supply of liquid in the pan and this flow improves the efficiency of the system. This furthermore prevents the evaporator roller from being able to freeze in the case of a low temperature in the supplied liquid, or in the case of a low ambient temperature, since the circulation of the liquid is increased and this region is warmed due to the introduction of liquid that is warm relative to the flake ice.

In another advantageous embodiment of the invention, the liquid supply intake has at least one outlet opening for the liquid, the opening being located between one of the two end faces of the evaporator roller and a pan side section. The liquid supply intake can furthermore be equipped with two or more outlet openings, one outlet opening each being located between one of the two end faces of the evaporator roller and a pan side section. This position of the outlet opening prevents ice from being able to form between the evaporator roller and a pan side section. Formation of ice in this region is undesirable since the ice at this position cannot be stripped by the scraper from the surface of the evaporator roller, and any formation of an ice layer in this region can thus cause the evaporator roller to freeze or freeze up. The outlet openings between the evaporator roller and the pan side sections can be combined with additional outlet openings below the scraper or at other positions.

In another advantageous embodiment of the invention, the liquid supply intake has a first channel and a second channel following the first channel in the flow direction of the liquid to convey the liquid. A space exists between the first and second channels in order to interrupt the outer guidance of the liquid jet, and to cause the liquid to flow freely in the space between the first and second channels. The first channel here is not connected to the second channel. Instead, a gap exists between the first and second channels comprising a free course for the jet of supplied liquid. The outer guidance of the liquid jet is interrupted at this point, with the result that the liquid flows freely in the space between the first and second channels. The second channel can be, for example, the hollow space of a tube that extends from the top far enough into the pan so that the outlet opening at the lower end of the channel is at a lower level than the intended fill level of the liquid in the pan. This enables the liquid to be introduced into the pan below the level of the surface of the liquid. To this end, the interruption between the first and second channels must be located above the intended level of the surface of the liquid in the evaporator roller. An overflow is provided in the region of the space between the first and second channels. This prevents the liquid from the pan from being able to move back into the liquid supply intake of the first channel in the event of a pressure drop. This thus prevents any retrograde microbial regrowth or contamination of the liquid supply intake. The introduction of liquid below the surface of the liquid ensures a turbulent flow of the liquid in the pan. This reduces the risk of contamination deposits in the pan, and reduces the danger of the liquid supply's freezing in the pan. The first channel and the upward-facing opening of the second channel are preferably located above the pan in the operating position.

In another advantageous embodiment of the invention, the second channel is of conical shape at its opening facing the first channel. The second channel here acts like a funnel that collects the incoming liquid jet even in the event of a divergence of the jet. To this end, the second channel is of greater cross-section at its opening facing the first channel than the opening of the first channel facing the second channel. The cross-section of the second channel is reduced as it adjoins the upward-facing opening. In addition, it is also possible to specify that the cross-section of the second channel be larger than the cross-section of the first channel.

In another advantageous embodiment of the invention, the apparatus is equipped with a liquid applicator disposed above the level of the shaft, the applicator applying the liquid to the evaporator roller. The liquid applicator here has multiple openings through which the liquid discharges. This liquid applicator can be disposed on the apparatus either alternatively or cumulatively to a liquid supply intake. The liquid applicator functions to apply the liquid to be frozen onto the evaporator roller while the liquid supply intake introduces the liquid to be frozen into the pan. The liquid applicator enables both the performance of the apparatus to be enhanced in terms of the production of flake ice, and also the quality of the flake ice to be improved. In the case of an evaporator roller oriented horizontally, the liquid applicator can be disposed above the evaporator roller such that the application of the liquid is effected from the top onto the evaporator roller. In addition, the liquid applicator can be disposed next to the evaporator roller so that the application of liquid does not occur at the highest point of the evaporator roller but instead below the highest point at the side. The liquid applicator can comprise, for example, a spray tube that is oriented parallel to the shaft of the apparatus and extends across the entire length of the evaporator roller, or at least across more than 80% of the length of the evaporator roller. The liquid applicator is advantageously disposed on the apparatus independently of the pan, so that the pan can be installed and removed without having the liquid applicator interfere with the installation or removal. The liquid applicator can nevertheless be disposed detachably on the apparatus. The liquid applicator can be removed from the apparatus to allow the evaporator roller to be cleaned.

In another advantageous embodiment of the invention, the apparatus is equipped with a pump that draws liquid out of the pan and returns it to the pan through openings in the liquid applicator.

In another advantageous embodiment of the invention, the apparatus is equipped with a liquid drain. The opening of the liquid drain facing the interior of the pan is located in one of the pan side sections close to the pan base section. This opening is located especially preferably at the lowest point of the pan side section when the pan is in the operating position. The result is that the liquid essentially drains completely from the pan. The liquid drain is preferably equipped with a tube that projects outward from the pan side section. This arrangement of the liquid drain has the advantage that the laterally-outward-projecting tube does not impede the pan from swiveling or rotating when it is inserted since the tube does not increase the radius required for the pan. The tube can be fitted with a hose or an additional tube by means of a coupling so as to conduct away the liquid draining out of the pan.

In another advantageous embodiment of the invention, the apparatus is equipped with a cover for the pan. This covers the pan at least partially at the top when the pan is in the installed state. The liquid supply intake, for example, can be detachably or permanently disposed on the cover.

Additional advantages and advantageous embodiments of the invention can be found in the following description, drawing, and claims.

BRIEF DESCRIPTION OF THE DRAWINGS

One exemplary embodiment of the apparatus according to the invention is illustrated in the drawing. Here.

DESCRIPTION OF THE EXEMPLARY EMBODIMENT

Figure 1:
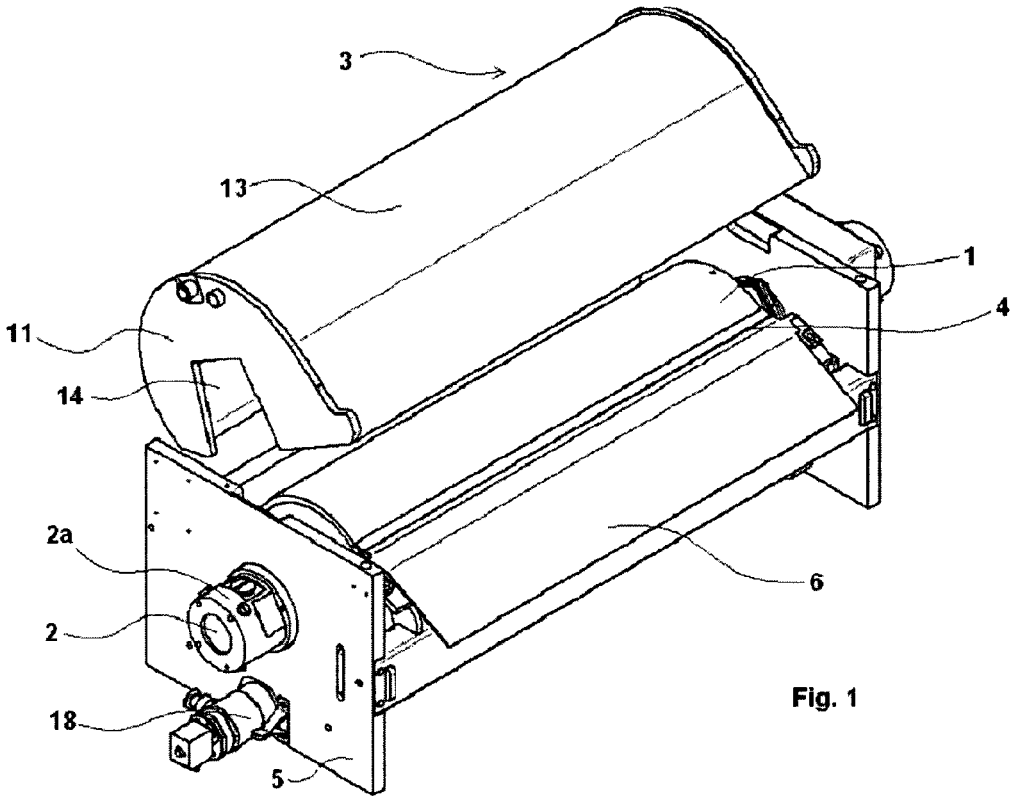
FIG. 1 is a perspective view of a first embodiment of an apparatus for producing flake ice, with the pan having been lifted.
Figure 2:
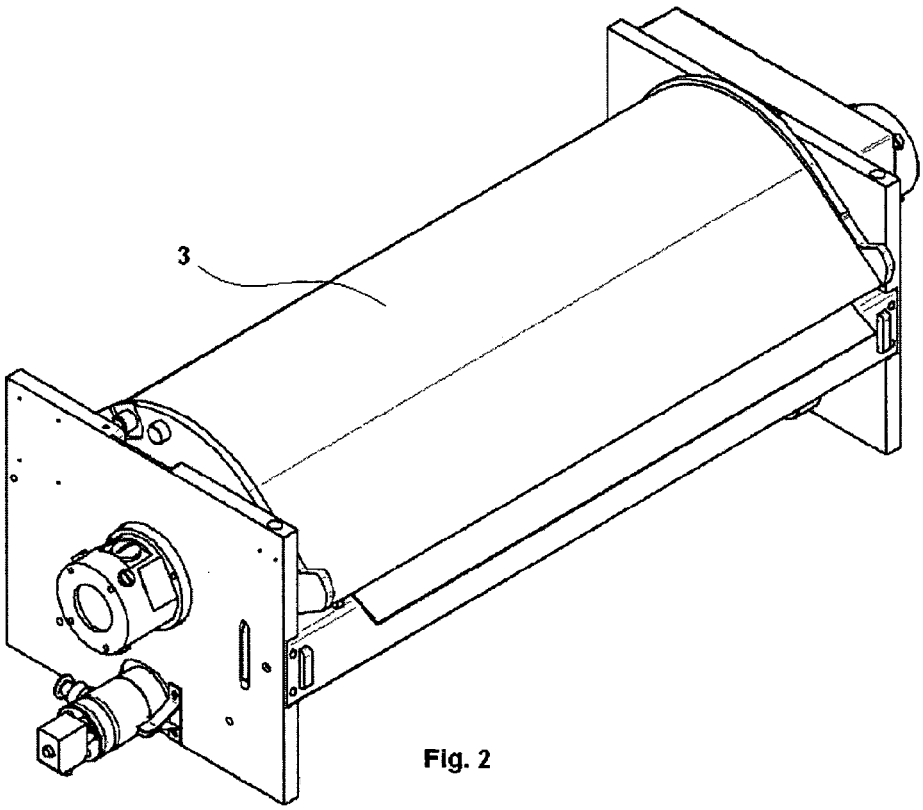
FIG. 2 depicts the apparatus of FIG. 1 with the pan placed on the coupling elements.
Figure 3:
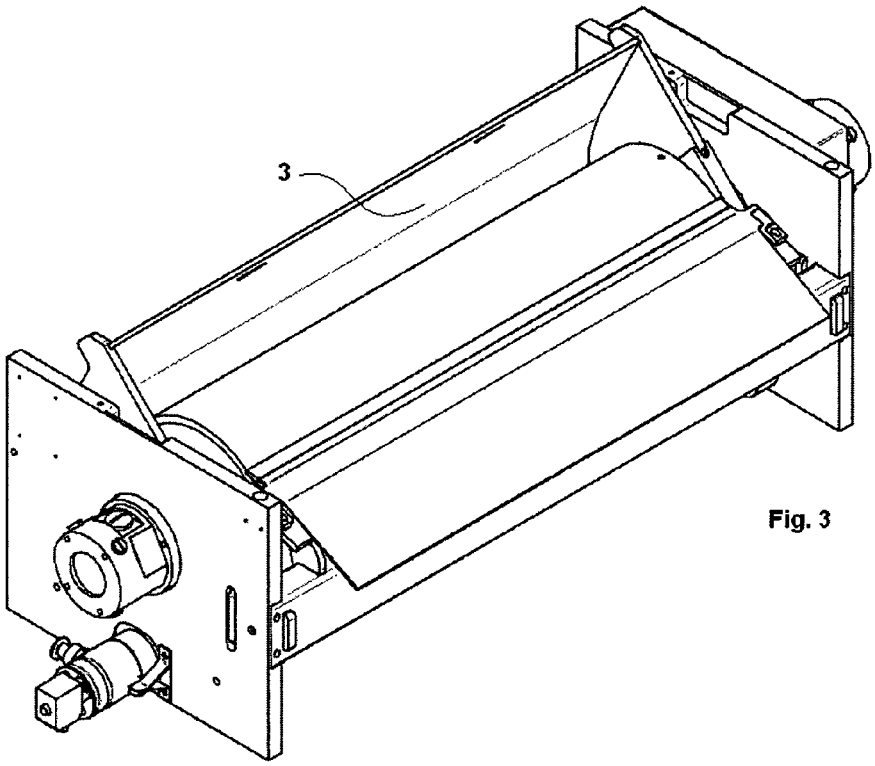
FIG. 3 depicts the apparatus of FIG. 1 with the pan having been placed in position and partially rotated.
Figure 4:
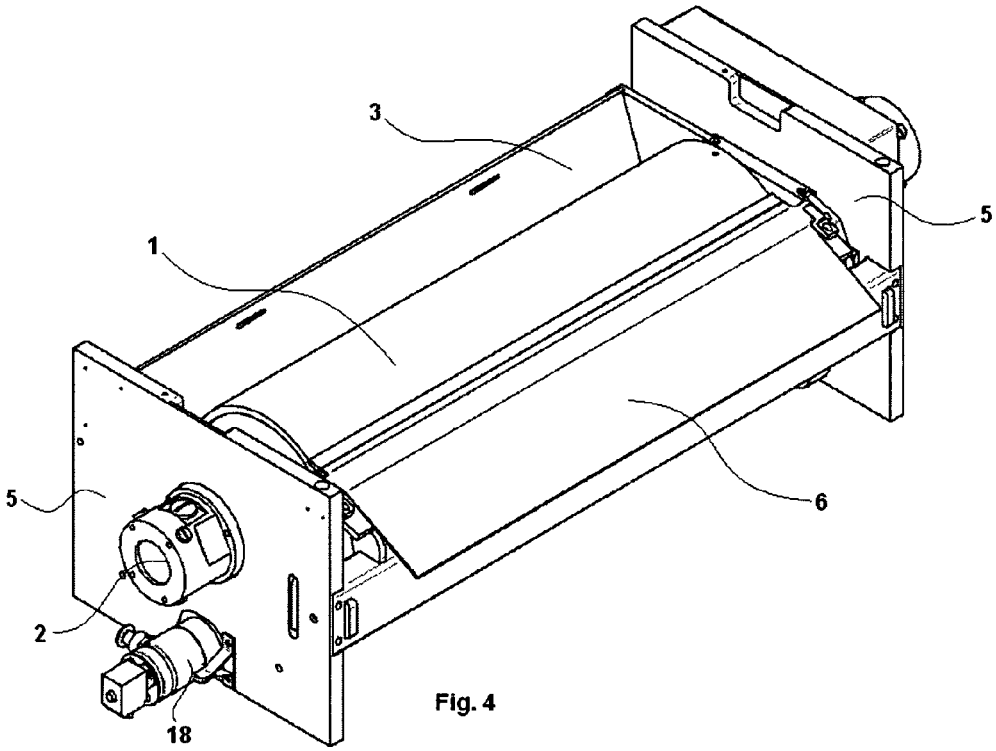
FIG. 4 depicts the apparatus of FIG. 1 with the pan in the operating position.

FIGS. 1 through 11 depict a first embodiment of an apparatus for producing flake ice, comprising an evaporator roller 1, a shaft 2 of evaporator roller 1, two bearing bushings 2*a* in which the shaft 2 is rotatably supported, a pan 3, and a scraper 4. Evaporator roller 1 here is permanently attached to the shaft. Bearing bushings 2*a* are permanently disposed in the walls 5 of a housing. Shaft 2 and thus evaporator roller 1 are driven so as to rotate by a drive, not shown in the drawing. When pan 3 is located in the operating position, as shown in FIGS. 4 and 5*f*, evaporator roller 1 immerses into a liquid supply in the pan. The evaporator roller is cooled and so the liquid freezes at the surface of evaporator roller 1. As the evaporator roller rotates, this freezing layer is carried along and stripped by scraper 4 from the surface of evaporator roller 1. The flake ice stripped from the evaporator roller is conveyed away over an inclined plane 6, also identified as an ice deflector.

Figure 7:
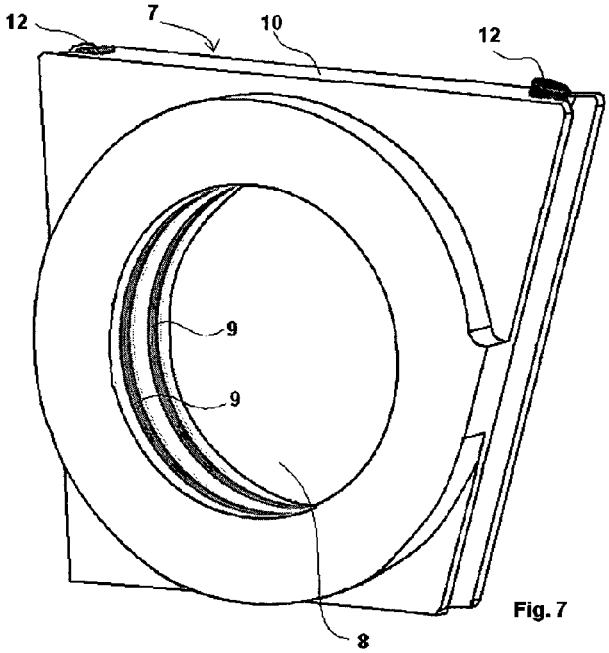
FIG. 7 is a perspective view of the coupling element of the apparatus of FIG. 1.

This pan is detachably connected to the rest of the apparatus to enable the pan to be cleaned more effectively. To this end, one coupling element 7 each is rotatably disposed on bearing bushings 2*a* between each wall 5 of the housing and evaporator roller 1. Each of the two coupling elements 7 is composed of a disk with a circular cutout 8 in which bearing bushing 2*a* is disposed. FIG. 7 provides a perspective view of a coupling element. Seals 9 are located in the circular cutouts to seal the junction between bearing bushing 2*a* and coupling element 7. The surface of coupling element 7 facing the viewer in FIGS. 5*a* through 5*f* has the shape of an irregular quadrangle, except for the circular cutout. Except for the upper edge 10 that faces upward when pan 3 is in the operating position, the coupling element has three other sides that face the side sections 11 of the pan when pan 3 is inserted, as in FIGS. 5*d* through *f*. These end faces of coupling elements 7 are equipped with a seal 12 that is disposed in a recess. These seals ensure a fluid-tight attachment between coupling elements 7 and pan side sections 11 of the pan when the pan is in the operating position, as in FIGS. 4 and 5*f*.

Figure 5A:
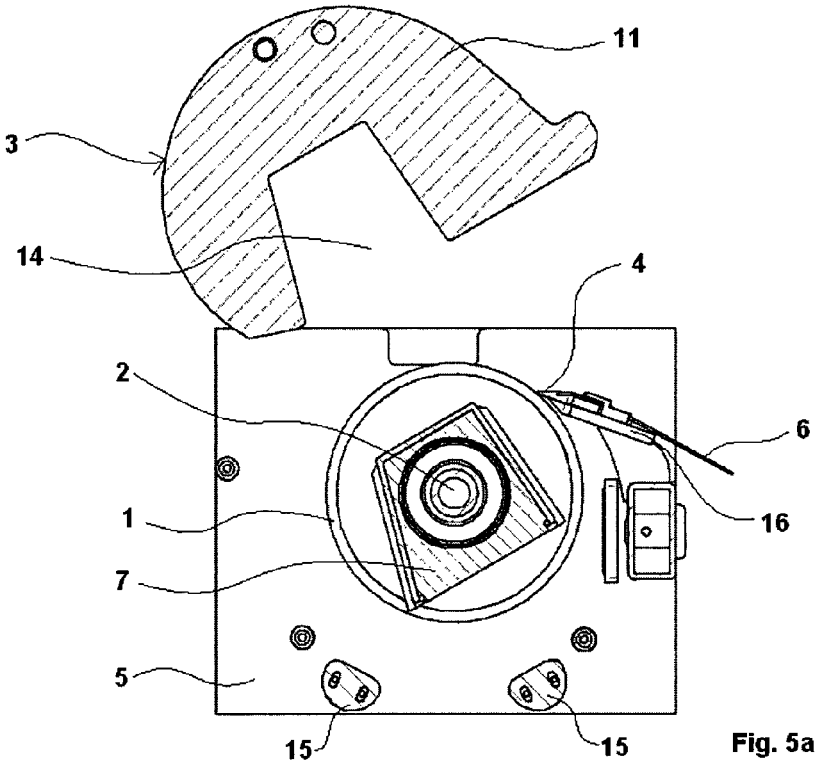
FIGS. 5*a* through 5*f* depict the apparatus of FIG. 1 as viewed from side with the housing partially cut away, showing various positions of the pan when it is inserted into the apparatus.
Figure 5B:
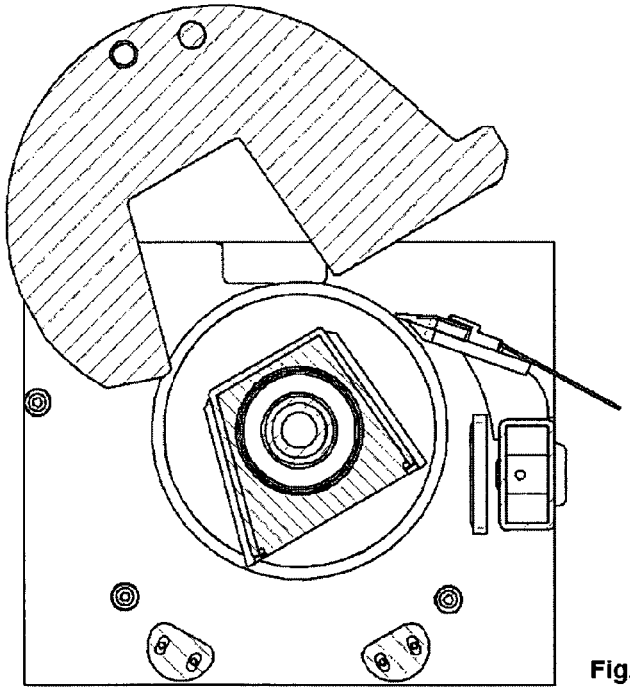
Figure 5C:
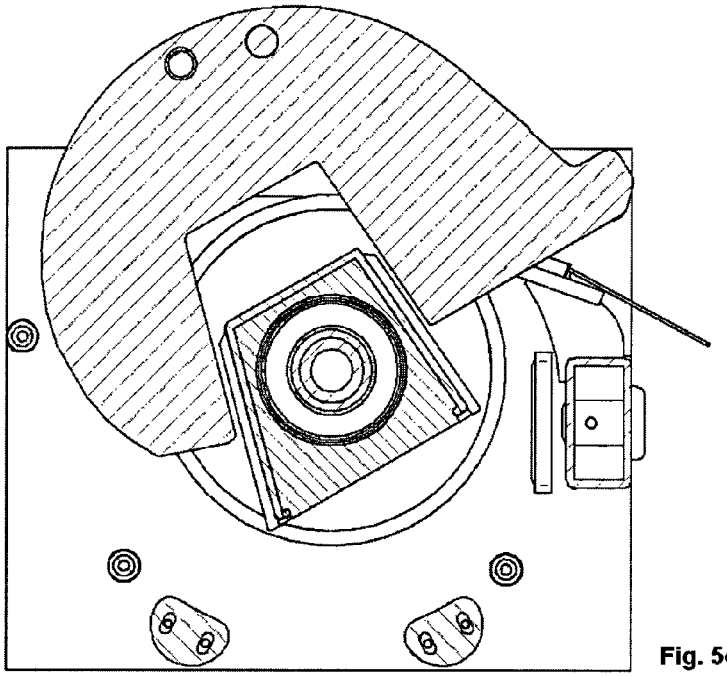
Figure 5D:
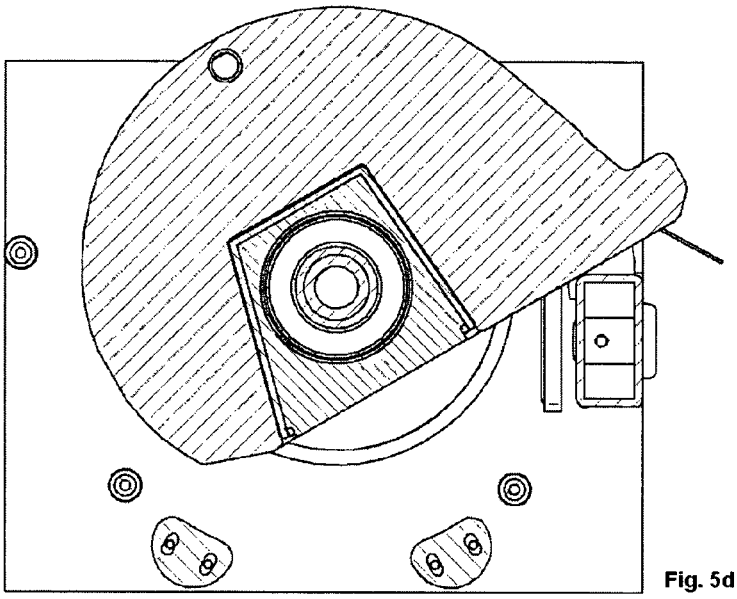
Figure 5E:
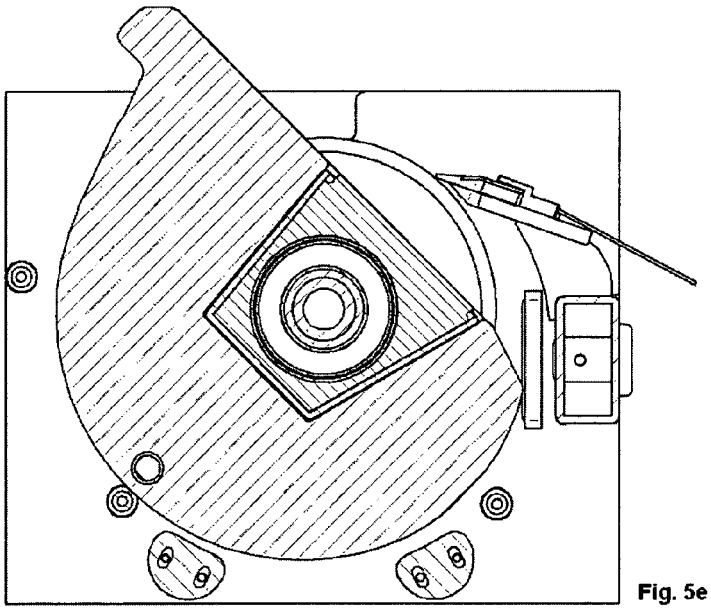
Figure 5F:
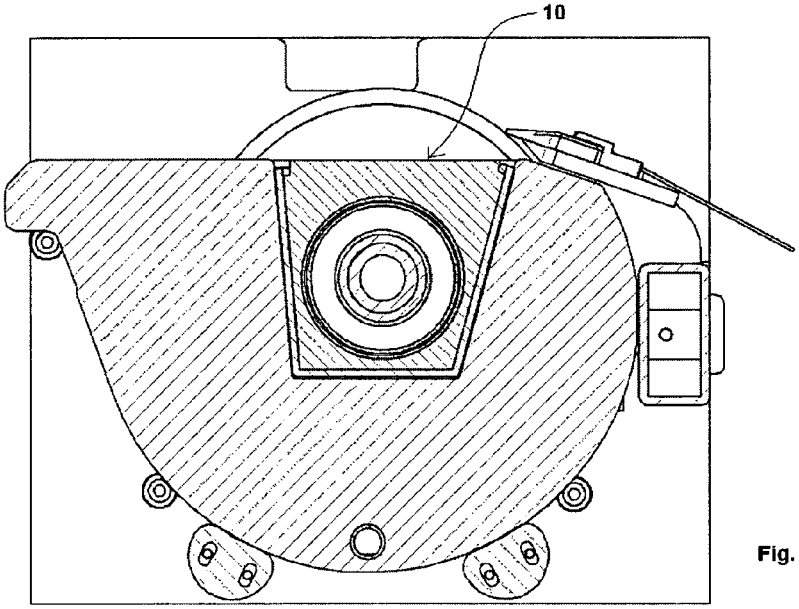

Pan 3 is composed of two pan side sections 11 and a pan base section 13 that is disposed between these and that connects the two pan side sections to each other. Each of the two pan side sections has a quadrangular cutout 14 that is matched to the shape of coupling elements 7. After pan 3 has been completely placed in position, as shown in FIGS. 5*d* through 5*f*, the upper edge of coupling elements 7 is flush with the upper edge of pan side sections 11.

Pan side sections 11 have a round outer contour. Pan base section 13 is curved outward to match the pattern of the outer contour of the pan side sections.

Elements 15 function as an attachment device, the elements being disposed on walls 5 of the housing. In the operating position of FIGS. 4 and 5*f*, the pan rests by its pan side sections on the elements and is held by these. This ensures a form-fitting engagement between pan side sections 11 and coupling elements 7. Seals 12 here are elastically deformed.

Scraper 4 is disposed on a cross-member 16 that is in turn attached to the housing. Cross-member 16 is visible in the diagrams of FIGS. 5*a* through 5*f*. Inclined plane 6 is also disposed on the cross-member.

Figure 6A:
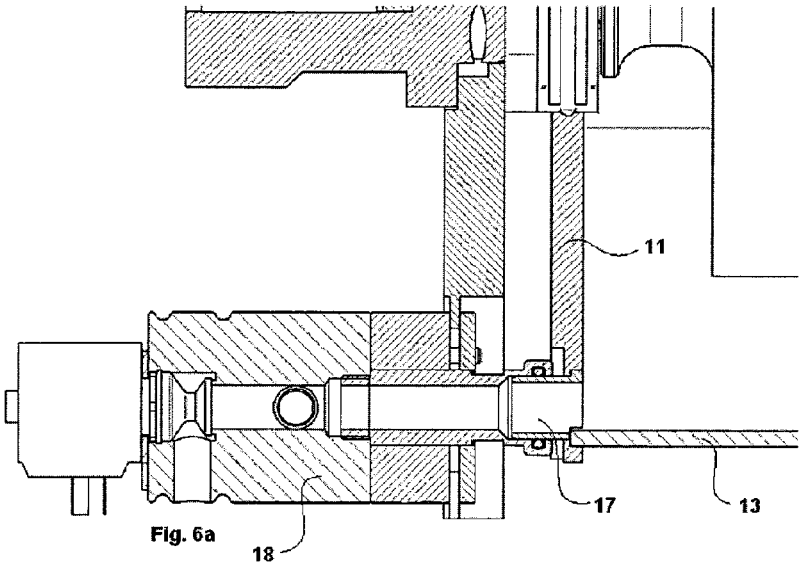
FIGS. 6*a* and 6*b* depict the liquid drain in a first setting in which an exterior connector is connected to the pan, and in a second setting in which the exterior connector is not connected to the pan.
Figure 6B:
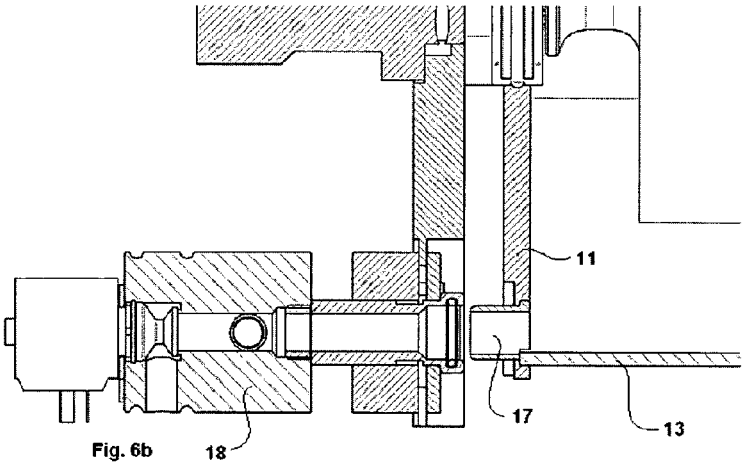

FIGS. 6*a* and 6*b* depict the liquid drain of pan 3. On one of its pan side sections 11, pan 3 has an opening close to the pan base section, a tube 17 being connected to this opening. This tube is tightly connected to a drain disposed on the housing by means of a slidable coupling 18.

Figure 8:
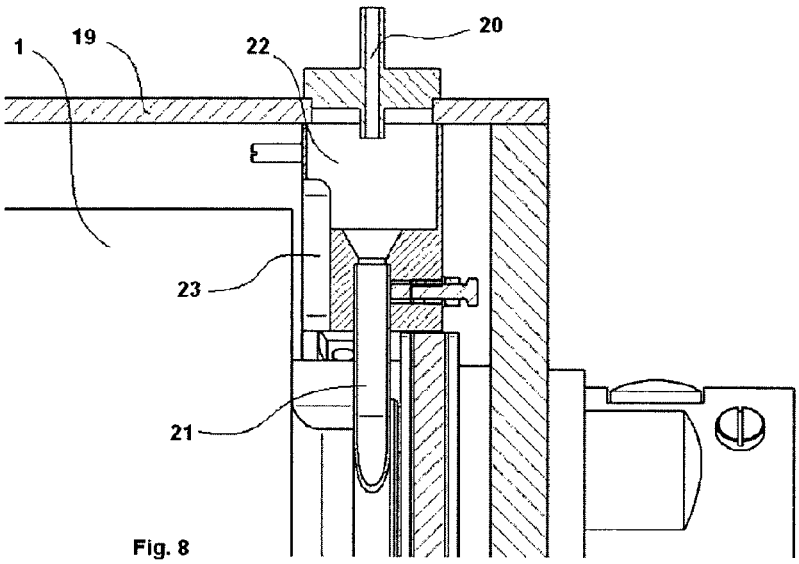
FIG. 8 depicts the liquid supply intake of the apparatus in FIG. 1.

FIG. 8 depicts the liquid supply intake that is disposed in a cover 19 of the housing. The liquid supply intake has a first channel 20 and a second channel 21. First channel 20 and the upward-pointing end of second channel 21 run vertically and are disposed coaxially in succession. First channel 20 is located above second channel 21. A space 22 is provided between the two channels, the space functioning to provide an interruption in the guidance of the liquid. The space is composed of a chamber that allows the liquid to drain to the outside. The chamber is equipped with an overflow 23 for this purpose. Second channel 21 is equipped at its top end with a funnel-shaped inlet. The liquid supply intake has a first channel and a second channel following the first channel in the flow direction of the liquid to convey the liquid, that a space exists between the first and second channels space to interrupt the outer guidance of the liquid jet and to cause the liquid to flow freely in the space between the first and second channels.

Figure 9:
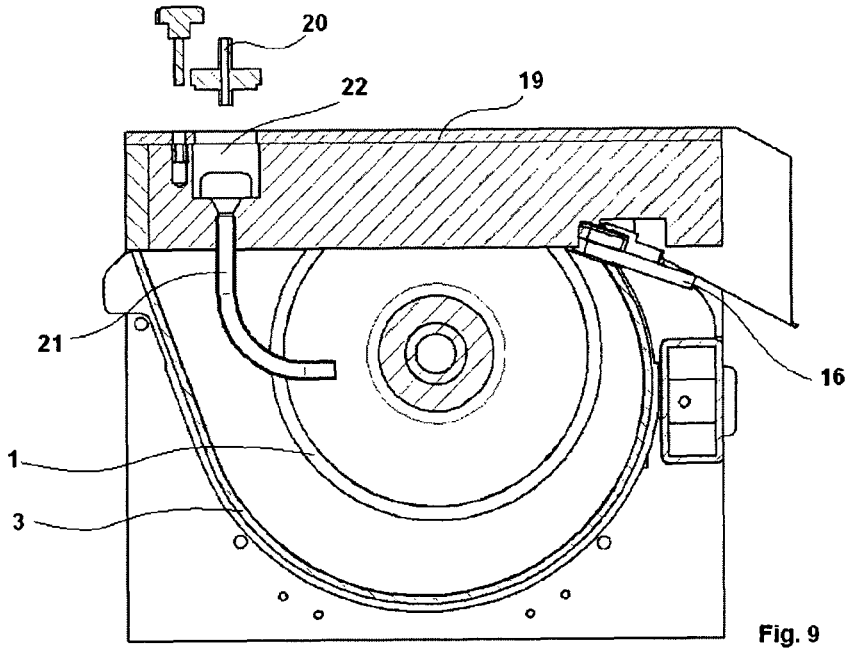
FIG. 9 is a side view of the apparatus with liquid supply intake.

FIG. 9 depicts an embodiment of an apparatus in which the liquid supply intake is implemented through channels 20 and 21 along side of pan 3 facing away from cross-member 16 of the scraper. Alternatively, the supply intake can also be implemented on the opposite side below the scraper.

Figure 10:
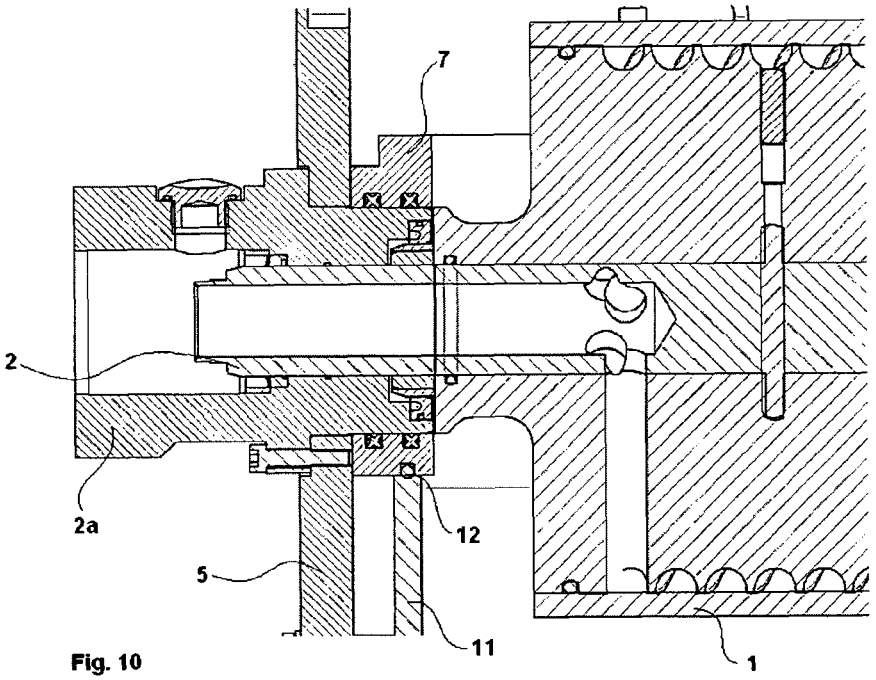
FIG. 10 depicts a section through a part of the apparatus.

FIG. 10 is a cutaway view showing the arrangement of evaporator roller 1, shaft 2, bearing bushing 2*a*, wall 5 of the housing, coupling element 7, and seal 12.

Figure 11:
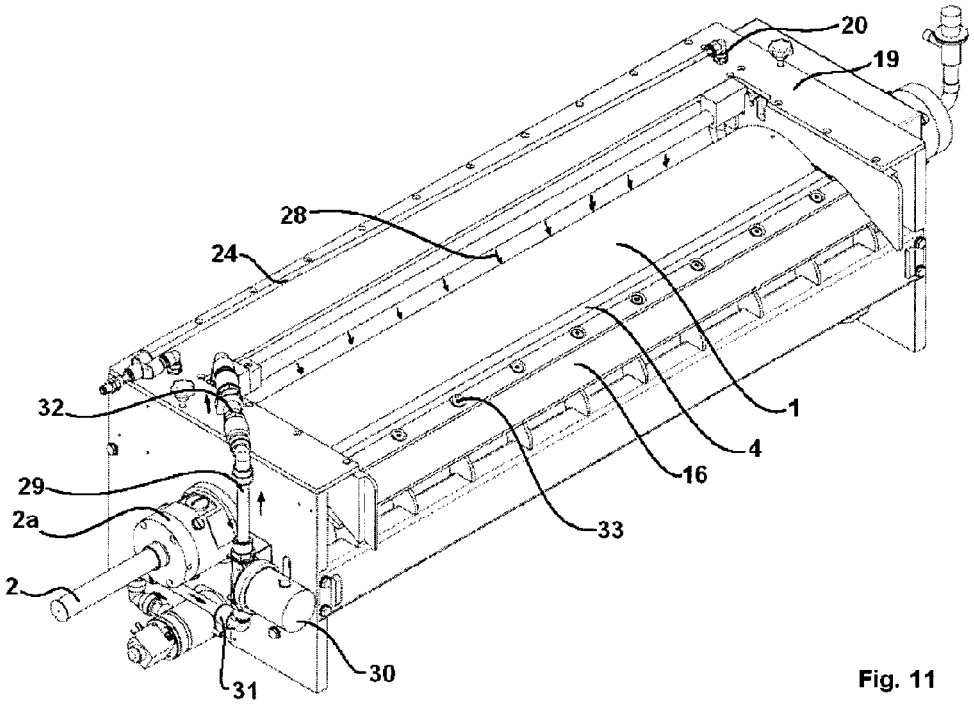
FIG. 11 is a perspective view of the apparatus of FIGS. 1 through 5 with liquid applicator.

FIG. 11 depicts the apparatus of FIGS. 1 through 5 in the operating position of the pan, comprising an additional cover 19, supply intake 24 for first channel 20 of the liquid supply intake, and a liquid applicator 25. Cover 19 covers the apparatus at least partially at the top. In addition, supply intake 24 is attached to the cover, the intake supplying the liquid to be frozen to two first channels 20 that are shown in the cutaway view in FIG. 8. The two first channels 20 are each disposed above evaporator roller 1, and laterally between the end face of evaporator roller 1 and the pan side sections when the pan is in the installed position. Supply intake 24 and first channels 20 can be detached from the apparatus together with cover 19. Liquid applicator 25 has spray tube 26 that is detachably disposed on the apparatus parallel to shaft 2 and to evaporator roller 1. The tube is hooked into receptacles 27 provided for this purpose at both ends. The spray tube has openings, not visible in the drawing, that face evaporator roller 1. The liquid to be frozen discharges from these and moves by gravity in the direction of arrows 28 onto the peripheral surface of evaporator roller 1. Spray tube 26 is connected by a pressure line 29 to pump 30. Pump 30 draws liquid from the pan through a suction line 31 connected to the pan and conveys it through pressure line 29 and spray tube 26 to evaporator roller 1. The pressure line is equipped with a quick release fastener 32 that enables the spray tube to be at least partially decoupled from pressure line 29.

Attachment means 33 are visible in FIG. 11 by which scraper 4 is attached to cross-member 16.

FIGS. 12 through 16 depicts a second embodiment of an apparatus for producing flake ice, comprising an evaporator roller 34, a shaft 35, two bearing bushings 36 in which shaft 35 is rotatably supported, a pan 37, a scraper 38, walls 39 of a housing in which bearing bushings 36 are disposed, and an inclined plane 40 to remove the ice. In contrast to the first embodiment shown in FIGS. 1 through 11, pan 37 is not attached by coupling elements but placed directly onto bearing bushings 36.

Figure 12:
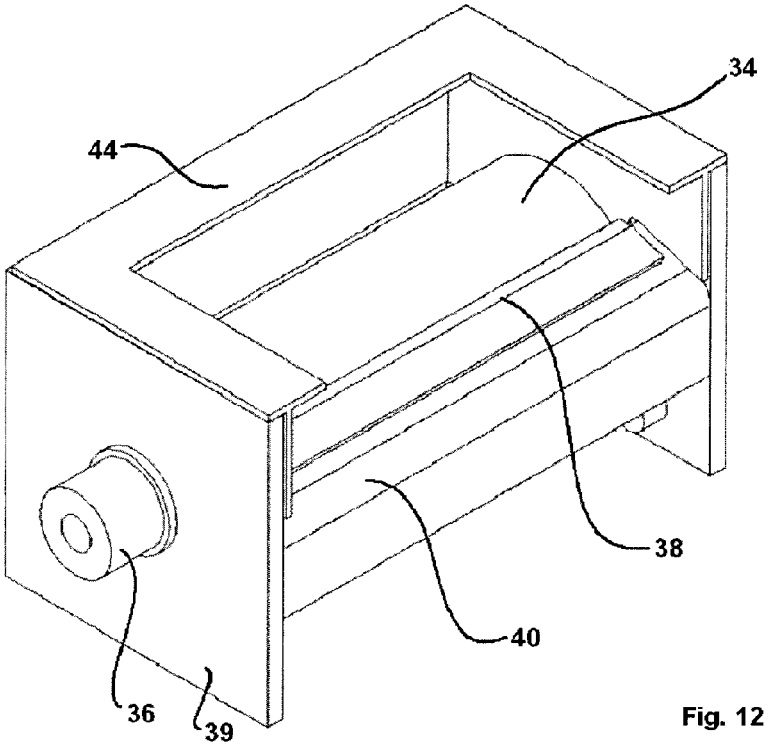
FIG. 12 is a perspective view of a second embodiment of an apparatus for producing flake ice.

FIGS. 13 through 16 provide a side view of the apparatus of FIG. 12 in which wall 39 of the housing facing the viewer is absent, while bearing bushings 36, shaft 35, cross-member 45, and elements 43 of an attachment device are viewed in cross-section.

Pan 37 has one cutout 42 each on opposite pan side walls 41, the cutout being matched to bearing bushings 36. Cutouts 42 each create a receptacle for both bearing bushings 36. Both cutouts 42 have the shape of a semicircle. This is evident in FIG. 16. Each of the two bearing bushings 36 is of circular shape in cross-section and has a circular cutout in which shaft 35 is rotatably supported. Seals are located on the bearing bushing on the side facing the pan when in the operating position in order to seal the junction between bearing bushings 36 and pan 37. The seals are not visible in the drawing.

Pan 37 has pan side walls 41, and a pan base section disposed between these and connecting the two pan side walls 41 to each other. The pan base section is not visible in the diagram of the drawing.

Pan 37 is higher at the side facing scraper 38 than the remaining sides when in the operating position. This first of all facilitates installation and removal of pan 37. Secondly, pan 37 extends up to scraper 38 thanks to this shape. Aside from the region facing scraper 38 and the two cutouts 42, the upper edge of pan 37 is oriented in a horizontal straight line when in the operating position.

In the operating state, pan side walls 41 have a round outer contour on the side facing down. The pan base section is correspondingly curved outward to match the pattern of the outer contour of pan side walls 41.

Elements 43 function as an attachment device that is disposed on walls 39 of the housing. In the operating position of FIG. 13, the pan rests by its pan side walls 41 on elements 43 and is held by these. This ensures a form-fitting engagement between pan side walls 41 and bearing bushings 36. The seals here are elastically deformed.

Figure 13:
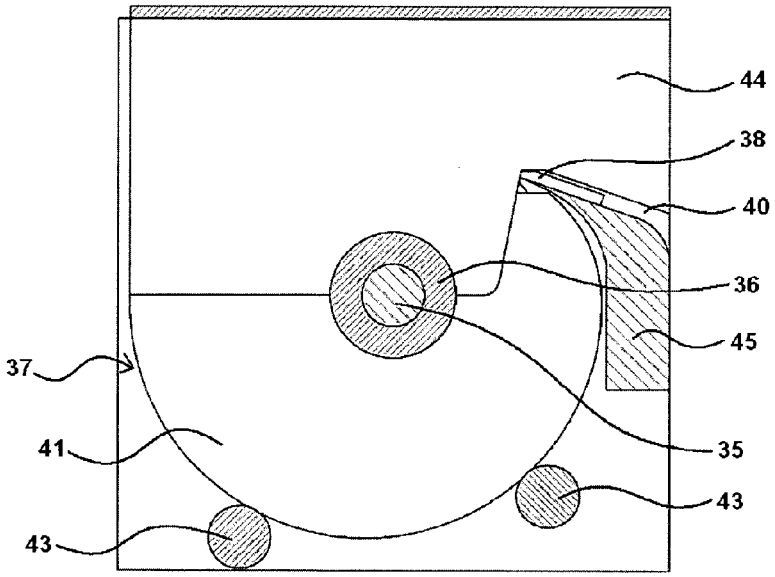
FIG. 13 is a side view of the apparatus of FIG. 12 without housing wall.
Figure 14:
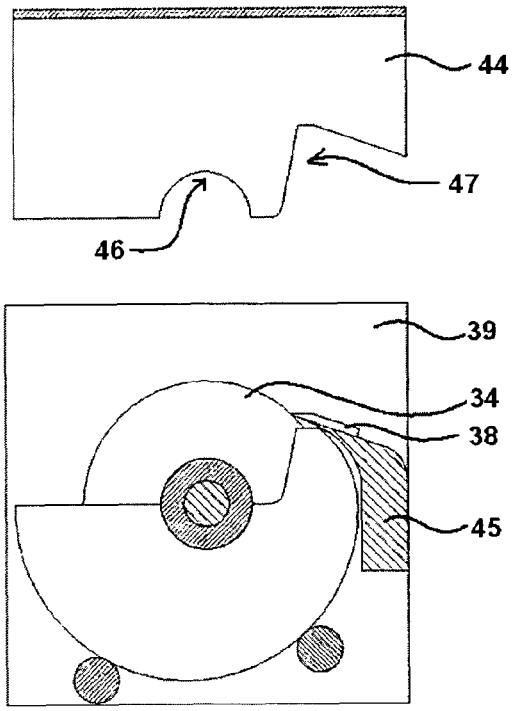
FIG. 14 depicts the apparatus of FIG. 13 with the pan upper section having been lifted.
Figure 15:
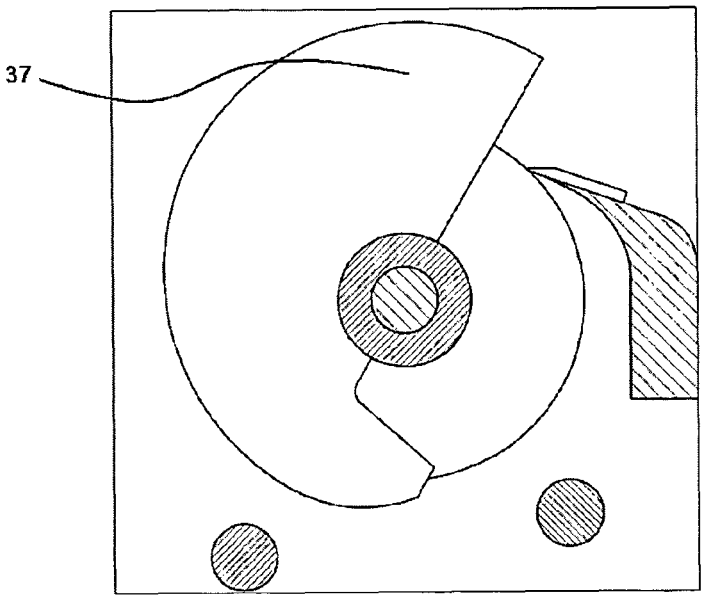
FIG. 15 depicts the apparatus of FIG. 13 without pan upper section, with the pan having been rotated with respect to the operating position.
Figure 16:
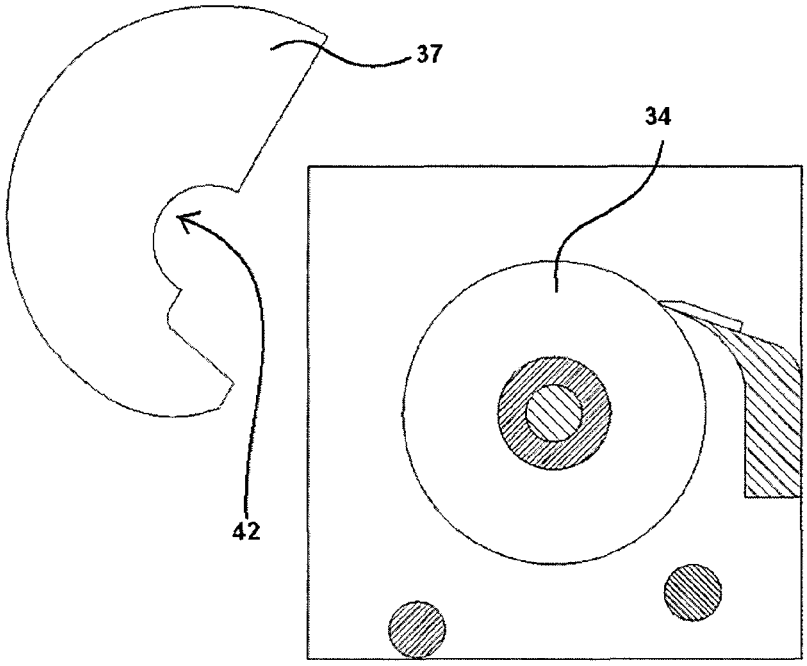
FIG. 16 depicts the apparatus of FIG. 13 with the pan having been released from the bearing bushings.
Figure 17:
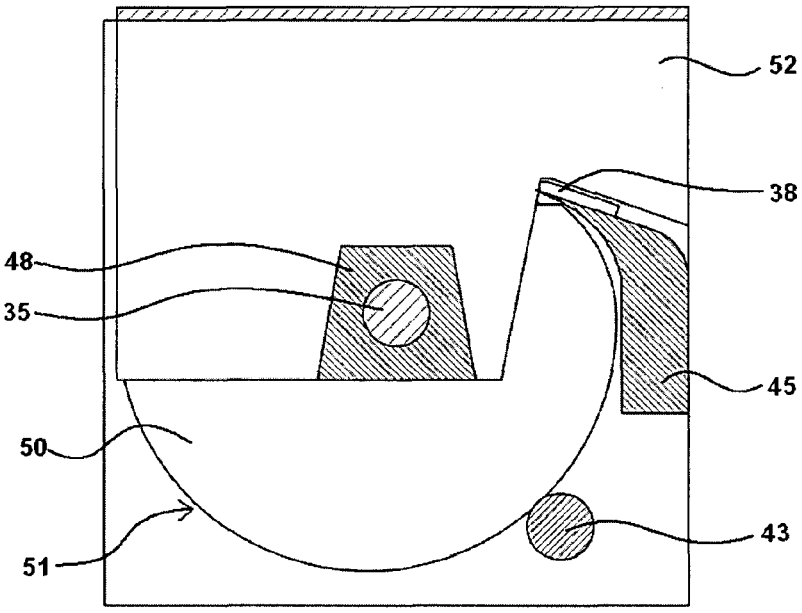
FIG. 17 is a side view without the housing wall, showing a third embodiment of an apparatus for producing flake ice.
Figure 18:
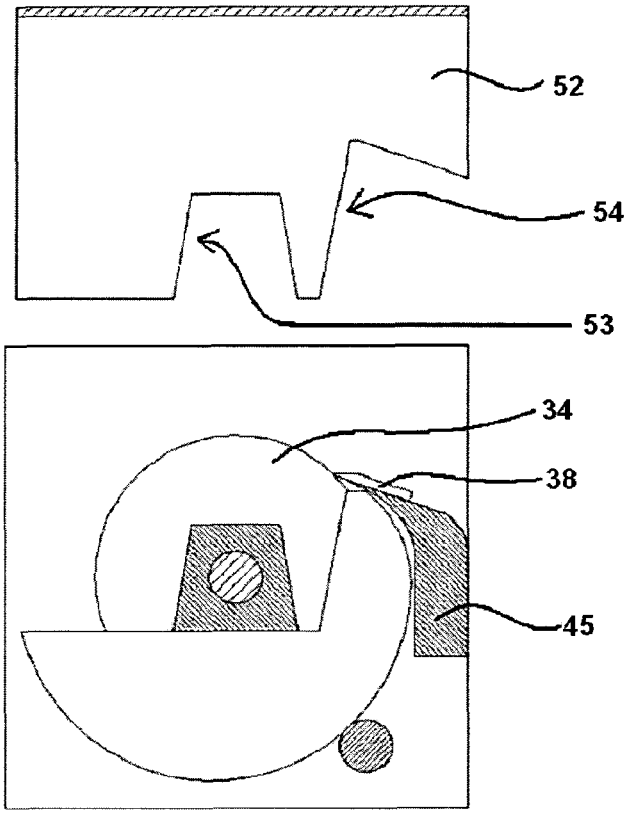
FIG. 18 depicts the apparatus of FIG. 17 with the pan upper section lifted.
Figure 19:
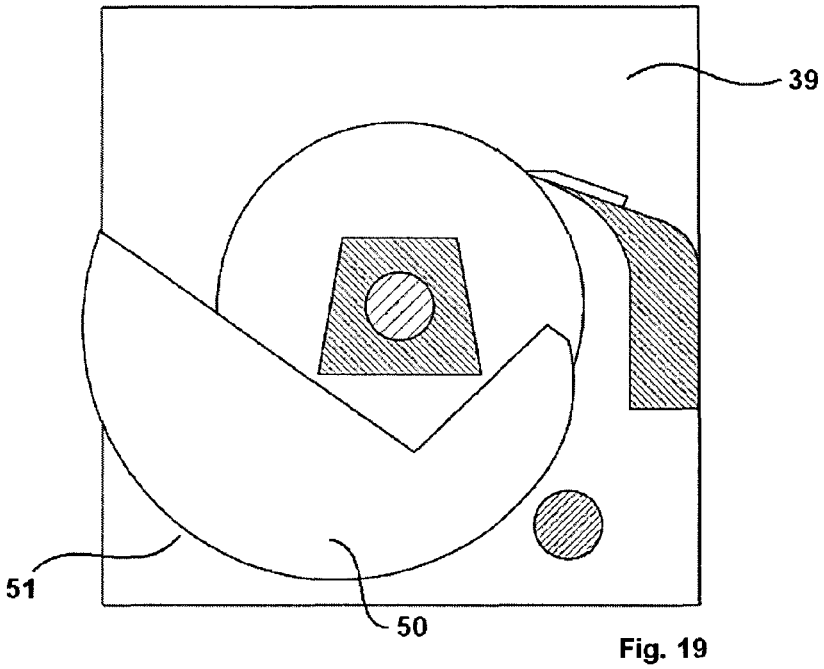
FIG. 19 depicts the apparatus of FIG. 17 without pan upper section, with the pan having been rotated with respect to the operating position.
Figure 20:
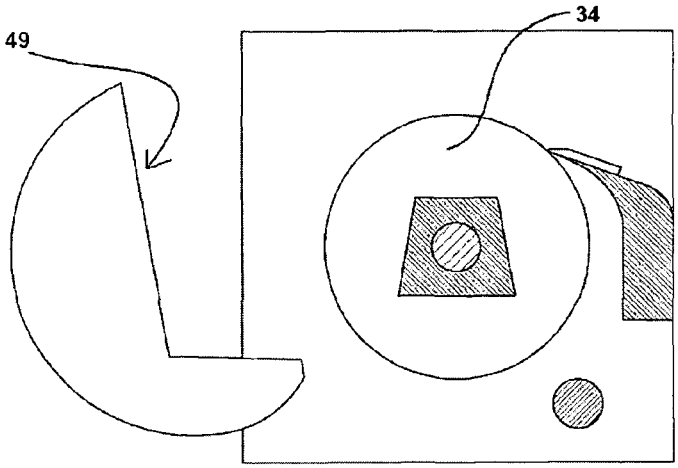
FIG. 20 depicts the apparatus of FIG. 17 with the pan released from the bearing bushings.

Pan 37 is furthermore equipped with a pan upper section 44 that in the operating position of FIGS. 12 and 13 has been placed on pan 37 from above and at least partially covers pan 37 at the top. The pan upper section constitutes a complementary component to pan 37 and bearing bushings 36. Pan upper section 44 also has pan upper-section side walls that are equipped with cutouts 46. These cutouts are identical or similar to cutouts 42. In addition, pan upper section 44 has a second cutout 47 for scraper 38 and the raised region of pan 37 that faces the scraper. Pan upper section 44 has an opening at the top. This section rests on walls 39 of the housing.

Scraper 38 is disposed on cross-member 45 that in turn is attached to the housing. Inclined plane 40 is also disposed on cross-member 45.

A third embodiment of an apparatus for producing flake ice is depicted in FIGS. 17 through 20. The perspective view from the outside is identical to FIG. 12. In addition, the apparatus set forth in the third embodiment matches the apparatus set forth in the second embodiment—except for the shape of the bearing bushings, the shape of the cutout in the pan, and the cutouts in the pan upper section. The components of the third embodiment that match the second embodiment are identified with the same reference numerals. These are: evaporator roller 34, shaft 35, scraper 38, wall 39 of the housing, inclined plane 40, and cross-member 45. In contrast to the second embodiment, the outer shape of bearing bushings 48 is angular. Bearing bushing 48 has the shape of a trapezoid in the side view of FIGS. 17 through 20, in which wall 39 of the housing facing the viewer is absent, and bearing bushings 48, shaft 35, cross-member 45, element 43 of the attachment device are seen in cross-section. Cutout 49 in two opposing pan side walls 50 of pan 51 has an L-shape. Pan 51 extends up to cross-member 45 on the side facing scraper 38. Pan 51 is higher in this region than in the region facing bearing bushings 48. The apparatus is equipped with a pan upper section 52 that has two cutouts 53 and 54. First cutout 53 functions to receive bearing bushing 48, while second cutout 54 is provided for scraper 38 and the raised region of pan 51.

All features of the invention can be essential to the invention both individually and also in any combination with each other.

The invention claimed is:

1. An apparatus for producing flake ice from a liquid, comprising:

a housing;

an evaporator roller rotatably mounted on the housing;

a shaft on the evaporator roller that transmits a torque from a drive to the evaporator roller;

at least two bearing bushings permanently disposed on the housing, and the shaft is rotatably mounted and supported in the bushings;

a scraper to strip ice formed from the liquid on the surface of the evaporator roller;

a pan open at a top to receive the liquid to be frozen, the pan having two pan side sections and a pan base section that connects the pan side sections to each other and delimits the pan at front, rear and bottom;

the pan is insertable or slidable together with the pan side sections and the pan base section in one piece onto the bearing bushings, or onto coupling elements that are disposed on the shaft or on the bearing bushings, or directly onto the shaft;

the pan in an installed state provides a fluid-tight connection between the pan, and the bearing bushings coupling elements or the shaft that receive the pan and directly adjoin the pan when the pan is in the installed state;

the shaft and the evaporator roller are mounted on the housing independently of the pan; and the pan is installable to and removable from the housing together with the pan side sections and the pan base section in one piece while the evaporator roller remains rotatably mounted on the housing.

2. The apparatus according to claim 1, wherein the coupling elements circumferentially encompass the shaft or the bearing bushings.

3. The apparatus according to claim 1, wherein the shaft is rotatable relative to the coupling elements, or the coupling elements are rotatable relative to the shaft.

4. The apparatus according to claim 1, wherein a shaft seal is disposed on the shaft, the pan being couplable to the shaft seal.

5. The apparatus according to claim 1, wherein the pan side sections are equipped with a seal on a side facing the bearing bushings or the coupling elements, or the bearing bushings or the coupling elements are equipped with a seal on a side facing the pan.

6. The apparatus according to claim 1, wherein the pan side sections have a cutout on a side facing the opening of the pan, the cutout being matched to the bearing bushings or the coupling elements or the shaft.

7. The apparatus according to claim 1, wherein the pan side sections are equipped with a guide profile on a side facing the bearing bushings or coupling elements, or the bearing bushings or the coupling elements are equipped with a guide profile on a side facing the pan side sections.

8. The apparatus according to claim 1, wherein the pan side sections have a round outer contour, at least in a region in which they are attached to the pan base section.

9. The apparatus according to claim 8, wherein a distance between geometric longitudinal axis of the shaft and the outer contour of the pan side sections is shorter in a first section than in a second section, and the distance between the first and second sections increases continuously.

10. The apparatus according to claim 1, wherein the apparatus is equipped with an inclined plane along which the flake ice stripped by the scraper from the evaporator roller is conducted away, and the inclined plane is attached relative to the scraper and covers attachment elements by which the scraper is attached to a cross-member.

11. The apparatus according to claim 1, wherein the apparatus is equipped with at least one liquid supply intake that introduces the liquid from the top into the pan.

12. The apparatus according to claim 11, wherein the liquid supply intake has at least one outlet opening for the liquid, and the outlet opening is located below the scraper.

13. The apparatus according to claim 11, wherein the liquid supply intake has at least one outlet opening for the liquid, and the outlet opening is located between one of two end faces of the evaporator roller and a pan side section.

14. The apparatus according to claim 11, wherein the liquid supply intake has a first channel and a second channel following the first channel in a flow direction of the liquid to convey the liquid, a space interrupting an outer guidance of the liquid jet exists between the first and second channels so as to cause the liquid to flow freely in a space between the first and second channels.

15. The apparatus according to claim 1, wherein the apparatus is equipped with a liquid applicator disposed above a level of the shaft, the applicator applying the liquid to the evaporator roller, and the liquid applicator has multiple openings through which the liquid discharges.

16. The apparatus according to claim 15, wherein the apparatus is equipped with a pump that draws liquid out of the pan and conveys it through openings of the liquid applicator to the evaporator roller.

17. The apparatus according to claim 1, wherein the pan is equipped with a liquid drain, and an opening of the liquid drain facing an interior of the pan is located in one of the pan side sections close to the pan base section.

18. The apparatus according to claim 1, wherein retention elements are disposed on the housing that hold the pan by form-fitting engagement or by frictional engagement on the bearing bushings or coupling elements or the shaft when the pan is in the installed state.

* * * * *